United States Patent [19]

Holdsworth

[11] Patent Number: 5,028,220

[45] Date of Patent: Jul. 2, 1991

[54] COOLING AND LUBRICATION SYSTEM FOR A VACUUM PUMP

[75] Inventor: John E. Holdsworth, Michigan City, Ind.

[73] Assignee: Sullair Corpoation, Michigan City, Ind.

[21] Appl. No.: 566,737

[22] Filed: Aug. 13, 1990

[51] Int. Cl.[5] ..... F04C 29/02; F04C 29/04

[52] U.S. Cl. ..... 418/2; 418/84; 418/88; 418/97; 418/DIG. 1

[58] Field of Search ..... 418/2, 84, 88, 97, 98, 418/99, DIG. 1; 417/228

[56] References Cited

U.S. PATENT DOCUMENTS

| | | |
|---|---|---|
| 2,470,655 | 5/1949 | Shaw . |
| 2,937,807 | 5/1960 | Lorenz . |
| 2,938,664 | 5/1960 | Noller . |
| 3,073,514 | 1/1963 | Bailey . |
| 3,556,697 | 1/1971 | Webb . |
| 3,876,345 | 4/1975 | Froede . |
| 4,035,114 | 7/1977 | Sato . |
| 4,173,440 | 11/1979 | Libis . |
| 4,394,113 | 7/1983 | Bammert . |

FOREIGN PATENT DOCUMENTS

| | | | |
|---|---|---|---|
| 14895 | 2/1982 | Japan | 418/97 |
| 191490 | 11/1982 | Japan | 418/97 |

*Primary Examiner*—Leonard E. Smith
*Assistant Examiner*—David L. Cavanaugh
*Attorney, Agent, or Firm*—William D. Lanyi

[57] ABSTRACT

A fluid management system for a rotary screw vacuum pump is provided in which lubricating fluid is transmitted to the vacuum pump from an oil supply reservoir while a coolant fluid is circulated to the vacuum pump from a fluid reservoir containing a supply of liquid coolant. After passing through the rotary compressor and lubricating the compressor one time, the lubricant merges with the coolant and the mixture is stored in the fluid reservoir to be reused as a coolant for the rotary screw compressor. The fluid reservoir containing the fluid is provided with a controller that senses the quantity of liquid within the fluid reservoir and provides additional liquid to the reservoir when the liquid levels falls below a predetermined magnitude. In addition, the controller drains liquid from the fluid reservoir when the liquid level within the reservoir exceeds a predetermined magnitude. A water soluble lubricant is used in association with water as a coolant in a preferred embodiment of the present invention.

20 Claims, 2 Drawing Sheets

FIGURE I

COOLING AND LUBRICATION SYSTEM FOR A VACUUM PUMP

BACKGROUND OF THE INVENTION

1. Field of the Invention

The present invention relates generally to fluid supply systems for vacuum pumps and, more specifically, to a cooling and lubrication system for use in association with a rotary screw vacuum pump which requires both lubrication and coolant for proper operation.

2. Description of Prior Art

Skilled artisans are familiar with many different types of vacuum pumps and systems used for providing lubrication and cooling to those pumps. For example, U.S. Pat. No. 3,556,697, which issued to Webb et al on Jan. 19, 1971, provides a sealing arrangement for a vacuum pump that has end portions of its shaft extending through end walls of the pump housing. Each end of the shaft is provided with space labyrinth seals and a conduit to conduct sealing liquid to spaces between the seals of each shaft end. Low pressure produced at both shaft end portions draws sealing liquid through the associated seals into the pump housing.

U.S. Pat. No. 3,876,345 which issued to Froede et al on Apr. 8, 1975, discloses a rotary piston combustion engine that is provided with two separate oil circulating systems. One system provides cooling oil through the piston while the other serves to lubricate the shaft and the piston bearings. Each of these systems is provided with its own oil feed pump. The pump of the lubricating system has a small delivery volume at high pressure and the pump for the cooling oil system has a large delivery volume at a low pressure.

U.S. Pat. No. 4,035,114, which issued to Sato on July 12, 1977, discloses a method for reducing power consumption in a liquid cooled rotary compressor. Liquid for cooling, lubricating and sealing are separated from each other immediately after the mixture is delivered out of a compression chamber to a delivery chamber so that gas and liquid are allowed to behave separately. This method further comprises the step of regulating the amount of liquid injected into the compression chamber when the compressor is in operation.

U.S. Pat. No. 4,173,440, which issued to Libis on Nov. 6, 1979, describes a method and a device for lubricating compressors. It provides two lubrication circuits with a main circuit for lubricating the compression chamber and the various components of the compressor when operating under load and a secondary circuit for lubricating the components on the suction side while operating under no load. This system is especially applicable for use in association with air compressors.

U.S. Pat. No. 2,937,807, which issued to Lorenz on May 24, 1960, discloses a high vacuum pump wherein a pressure differential across the pump casing at the point where a shaft passes through the casing is maintained at a small fraction of the total pressure differential between the surrounding atmosphere and the pressure maintained within the pump. This arrangement permits the shaft to rotate freely without any confinement or friction due to packing material and, therefore, permits relatively small and inexpensive motors to drive the pump impellers at high rotational speeds for prolonged periods without requiring adjustment or replacement of the packing gland.

U.S. Pat. No. 3,073,514, which issued to Bailey et al on Jan. 15, 1963, discloses a rotary compressor which includes two or more rotors disposed within an outer housing and formed with intermeshing helical glands and grooves which, in prior forms of this type of compressor, have been operated dry with the rotors not in physical contact with each other or with the housing. The compressor of this patent is capable of compressing air and other gaseous fluids efficiently to higher pressure ratios in a single stage than previously. A liquid is introduced into the compressor for the dual purpose of providing a liquid seal that closes the clearance spaces that are characteristic of a dry compressor and for directly cooling the fluid being compressed to such material extent that compression can be effected to provide usual shop air pressure in a single stage.

U.S. Pat. No. 4,394,113, which issued to Bammert on July 19, 1983, discloses a rotary screw compressor for compressing a gas. This compressor is provided with a housing that has an annular drain space surrounding the rotor shafts at a location between each shaft bearing and the working space for the purpose of removing escaping lubricant and gas. The drain space is connected through a drain passage to a closed collecting chamber which is substantially under the intake pressure of the compressor. A return passage is provided for the purpose of returning gas to at least one of the intake and the working space of the compressor and for returning lubricant to a lubrication circuit.

U.S. Pat. No. 2,470,655, which issued to Shaw on May 17, 1949, describes a cooling and lubrication system for compressors which utilizes a solution of water and water soluble oil that is prepared in suitable proportions and injected into the compression chamber for diffusion therein. It is discovered that relatively small quantities of soluble oil dispersed in an excess of water provides a solution in which the oil is disseminated sufficiently throughout the water to render the solution an efficient lubricant as well as a coolant.

U.S. Pat. No. 2,938,664 which issued to Noller on May 31, 1960, describes a pump cooling arrangement wherein the pump is cooled by a cooling medium circulated through the pump elements. This system provides the pump members with suitable cooling means, such as conduits which pass through the pump members and which have a cooling liquid or the like circulated therethrough. The pump is provided with a housing that has at least two opposite walls which define a work space therebetween. At least one working member, which has a work portion in the work space and a pair of opposite axle portions projecting through the opposite walls, is mounted for rotation relatively to the housing. The work member has a conduit extending therethrough. A temperature controlling fluid medium is circulated through the conduit means of the work member for the purpose of controlling the temperature of that work member while the same rotates in the work space relative to the housing.

In most applications, rotary screw vacuum pumps are cooled and lubricated by a common fluid which is usually a petroleum based lubricating oil. This common cooling and lubricating fluid is generally circulated in a closed system by an oil pump. In vacuum pumps of this type, the process gas being evacuated is disposed in intimate contact with the cooling and lubricating fluid. When process gas that is being evacuated contains solvents, corrosive elements or fine particulate matter, the cooling and lubricating fluid quickly becomes contaminated. The contaminated fluid would damage the bearings, gears and seals of the rotary screw vacuum pumps if a closed system with a common lubricating and cooling fluid is used under these conditions. These circumstances make the use of the rotary screw vacuum pump impractical unless some means is provided to separate the coolant from the lubricant. These separating systems are both complicated and costly. It would be beneficial to the field of vacuum pump systems if a means could be provided that would permit the use of a standard rotary screw vacuum pump in systems in which the process gas being evacuated is a "trash gas" that contains solvents, corrosives or fine particulate matter. It would be further beneficial if the standard rotary screw vacuum pump could be used in association with systems of this type without requiring internal modification. The subject invention provides such a system and permits the use of a standard rotary screw vacuum pump with a moderate amount of additional equipment.

SUMMARY OF THE INVENTION

The present invention provides a vacuum pump fluid control system that comprises a means for providing a flow of pressurized oil in fluid communication with a vacuum pump. In addition, the present invention provides a means for providing a flow of pressurized water, or an alternative coolant fluid, in fluid communication with the vacuum pump. A fluid reservoir is provided and connected in fluid communication with a gas discharge port of the vacuum pump. This fluid reservoir is also connected in fluid communication with the means for providing a flow of pressurized water. A means is also provided for discharging gasses from the fluid reservoir.

The present invention is provided with a means for regulating the liquid level in the fluid reservoir wherein the regulating means, in turn, comprises a means for directing water into the fluid reservoir and a means for draining liquid from the fluid reservoir. The regulating means comprises a high level sensor and a low level sensor and, in addition, a controller that is connected in signal communication with the high and low level sensors and in signal communication with valves in the water directing means and the liquid draining means. In a system made in accordance with the present invention, a vacuum pump having an inlet port and an exhaust port is arranged with a fluid reservoir connected in fluid communication with its exhaust port and an oil supply connected in fluid communication with lubrication inlets of the vacuum pump. Furthermore, a cooling fluid inlet of the vacuum pump is connected in fluid communication with the fluid reservoir. In a preferred embodiment of the present invention, a pump is connected in fluid communication with the oil supply and with the lubrication inlets of the vacuum pump and another pump is connected in fluid communication with the cooling fluid inlet of the vacuum pump and the fluid reservoir. Means is provided for draining the fluid reservoir, for filing the fluid reservoir and for sensing the quantity of liquid in the fluid reservoir. A controller is provided for regulating the quantity of liquid in the fluid reservoir between first and second predetermined magnitudes. The controller in a preferred embodiment of the present invention can comprise either a microprocessor or an electronic circuit.

BRIEF DESCRIPTION OF THE DRAWING

The subject invention will be more fully understood from a reading of the description of the preferred embodiment in conjunction with the drawing, in which.

DESCRIPTION OF THE PREFERRED EMBODIMENT

Figure 1:
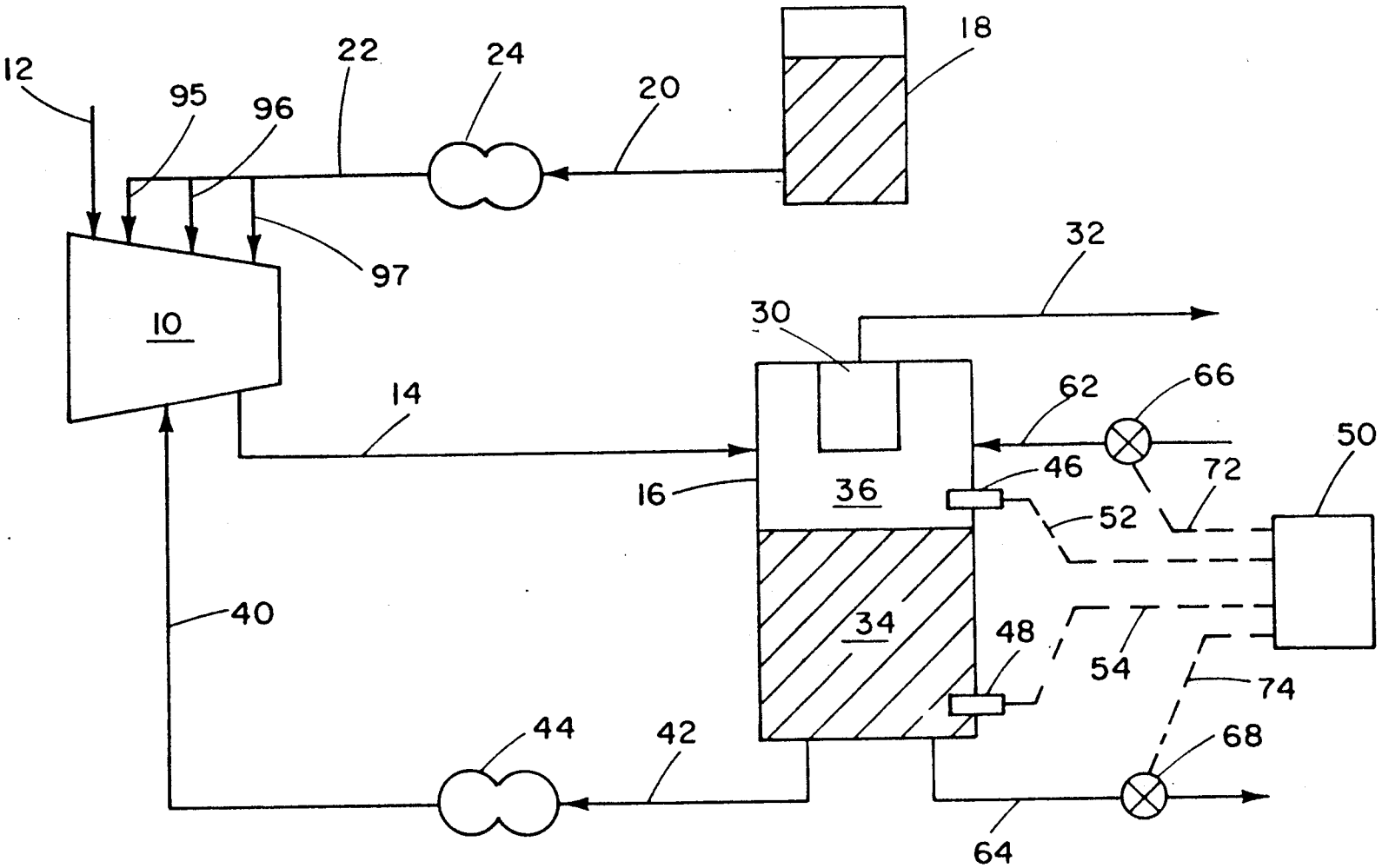
FIG. 1 is a schematic illustration of the fluid control system of the present invention.

Throughout the description of the preferred embodiment of the present invention, like reference numerals will be used to describe like components. The United States Patents described above by specific reference to their patent numbers are hereby explicitly incorporated by reference.

When rotary screw vacuum pumps are used to evacuate process gasses that contain solvents, corrosives or fine particulate matter (i.e. those process gasses sometimes referred to as "trash gasses"), the gasses pass into intimate contact with the oil that is used for the dual purposes of cooling and lubricating the rotary screw vacuum pump. The oil absorbs the gasses and carries the gasses through the system as it travels through the closed loop system commonly used in association with rotary screw vacuum pumps. As the contaminated cooling and lubricating oil is recirculated repetitively through the vacuum pump, severe damage can be caused to the bearings, gears and seals of the rotary screw vacuum pump. In closed systems, the provision of devices for separating the coolant fluid from the lubricant are complicated and costly. As a result, these types of trash gasses cannot practically be handled by rotary screw vacuum pumps because of the contamination of the cooling and lubricating fluid and the damage resulting as a consequence of this contamination.

The present invention contemplates the use of individual cooling fluid and individual lubricating fluid in a system which maintains a separation of the lubrication circuit from the cooling circuit. FIG. 1 illustrates a schematic representation of a system made in accordance with the present invention.

In FIG. 1, the rotary screw vacuum pump is schematically illustrated and identified by reference numeral 10. It is connected to a vacuum pump suction conduit 12, which is indicated by an arrow in FIG. 1 to represent the direction of travel of the process gas into the vacuum pump 10. The vacuum pump 10 is also provided with a discharge line 14 that is connected in fluid communication with both the vacuum pump 10 and a fluid reservoir 16. The fluid reservoir 16 will be described in greater detail below.

Lubricating oil is stored in an oil reservoir 18 that is connected in fluid communication with lubrication inlet ports of the vacuum pump 10 by conduits 20 and 22. An oil pump 24 is provided in the conduit line which provides fluid communication between the oil reservoir 18 and the lubrication inlet ports of the vacuum pump 10. It should be understood that, although three exemplary lubrication ports are shown in FIG. 1, alternative numbers of lubrication ports are possible within the scope of the present invention. The purpose of the oil reservoir 18 and the oil pump 24 is to provide a flow of oil to the vacuum pump 10 at a pressure that is at all times higher than the pressure of the coolant fluid and the pressure of the vacuum pump discharge. The flow of the lubricating oil is regulated to provide the minimum flow required for effective lubrication of the vacuum pump 10.

The fluid reservoir 16 is provided with a separator element 30 which discharges the gas, through line 32, from the upper portion of the fluid reservoir 16. As the gas is discharged from the vacuum pump 10 through line 14 into the fluid reservoir 16, liquids contained in the gas are accumulated in the liquid quantity 34 within the fluid reservoir. The gaseous portions of the discharge passing from line 14 into the fluid reservoir 16 accumulate in the ullage area 36 above the surface of the liquid and are discharged through the separator 30 and line 32 into the atmosphere or other suitable discharge receiving means.

A coolant inlet port of the vacuum pump 10 is connected in fluid communication with line 40 and line 42 which combine to connect the vacuum pump in fluid communication with the fluid reservoir 16. Pump 44 is provided to create a flow of liquid from the fluid reservoir 16 to the vacuum pump 10.

As oil is continually provided to the vacuum pump 10 from the oil reservoir 18, that oil combines with the coolant provided by line 40 to the vacuum pump 10 and the two liquids are discharged from the vacuum pump through line 14 into the fluid reservoir 16. As a consequence, the liquid level of the liquid quantity 34 in the fluid reservoir is expected to rise during operation of the vacuum pump 10.

The fluid reservoir 16 is provided with a high level sensor 46 and a low level sensor 48 that are capable of sensing the liquid level of the liquid quantity 34 in the fluid reservoir 16. The high level sensor 46 and the low level sensor 48 are connected in signal communication with a controller 50 by lines 52 and 54, respectively.

The fluid reservoir 16 is provided with a water supply line 62 and a liquid drain line 64. The water supply line 62 is provided with valve 66 and the liquid drain line 64 is provided with valve 68. The water supply line 62 is connected in fluid communication with an external source of water or other suitable cooling liquid. Valves 66 and 68 are connected in signal communication with the controller 50 by lines 72 and 74, respectively.

During normal operation of the system shown in FIG. 1, the controller 50 senses the liquid level of the liquid quantity 34 within the fluid reservoir 16 and responds accordingly. If the liquid level rises above the high level sensor 46, the valve 68 and the drain line 64 is opened and liquid is removed from the fluid reservoir for the purpose of lowering the liquid level below the level of sensor 46. If, on the other hand, the controller 50 senses that the liquid level has fallen below the position of the low level sensor 48, the controller opens valve 66 in the water fill line 62 and permits additional water, or suitable coolant, to flow into the fluid reservoir 16 to raise the level above sensor 48.

As the vacuum pump 10 is continually operated, the liquid quantity 34 in the fluid reservoir 16 will become progressively contaminated with corrosive elements from the trash gasses. Although a significant amount of trash gasses and corrosive elements pass through by the separator 30 and line 32, the liquid quantity 34 will eventually become contaminated beyond the amount that is tolerable by the vacuum pump 10. Therefore, the controller 50 periodically removes some of the liquid quantity 34 from the fluid reservoir 16 and refills the fluid reservoir 16 with clean coolant, such as water. This is done by opening valve 68 at least until the liquid level of the liquid quantity 34 falls below the low level sensor 48. Then, the valve 68 is closed and valve 66 is open until the fluid reservoir 16 is again filled with a sufficient liquid quantity 34.

It is important to note that the system in FIG. 1 contemplates the use of a water soluble lubricant. The lubricant, contained in oil reservoir 18, can be any suitable lubricant that is acceptable for use with a specific vacuum pump 10 chosen for the application. In addition, the lubricant provided by the oil reservoir 18 should be soluble in the liquid provided through line 62. For example, if line 62 is used to provide water as a coolant, the oil stored in the oil reservoir 18 should be water soluble. It should also be noted that the vacuum pump 10 is always provided with clean oil from the oil reservoir 18. In other words, the lubrication requirements of the vacuum pump 10 are satisfied with oil which has not yet come into contact with the trash gasses but, instead, is freshly supplied to the vacuum pump 10 from the oil reservoir 18. The coolant provided by line 40 is a mixture of a pure coolant, such as water, and the water soluble lubricant provided on lines 20 and 22 that has already passed through the exhaust line 14 during the previous operation of the vacuum pump 10. It should be apparent that, as the vacuum pump 10 continues to operate, the amount of oil in the liquid quantity 34 will continue to increase. The purity of the coolant in the liquid quantity 34 will therefore vary from pure water, or an alternative coolant provided on line 62, to a liquid that contains a high percentage of lubricant from oil supply 18 along with particulates carried in the process gas that passes into the pump 10 from line 12 and mixes with the coolant and lubricant as a result of the intimate contact between the process gas and the fluids used by the vacuum pump 10. The controller 50 can be provided with a means for determining the operating time of the vacuum pump 10 and causing the fluid reservoir 16 to be periodically drained as a function of operating time. This periodic draining, which has been described above, would result in the removal of some of the liquid quantity 34 from the fluid reservoir 16 and the replacement of that removed liquid by opening valve 66 in line 62 and refilling the fluid reservoir 16 with water or other suitable coolant. The algorithm performed by the controller 50, which has been discussed above, is relatively simple and can be provided by one skilled in the art of control systems. Two signal inputs are provided to the controller 50 on lines 52 and 54 and these signal inputs represent indications of the liquid level within the fluid reservoir 16. Two signal outputs are provided from the controller 50 to the valves 66 and 68 to open or close the valves. In view of the relative simplicity of the required algorithm in the controller 50, no specific algorithm or flow chart will be illustrated herein. However, it should be understood that the controller 50 can comprise a relatively simple electronic circuit or, alternatively, a relatively simple software program contained in a microprocessor. The selection and choice of the appropriate controller 50 will be a function of the specific application of the present invention and should not be considered limited to the scope of the present invention.

Figure 2:
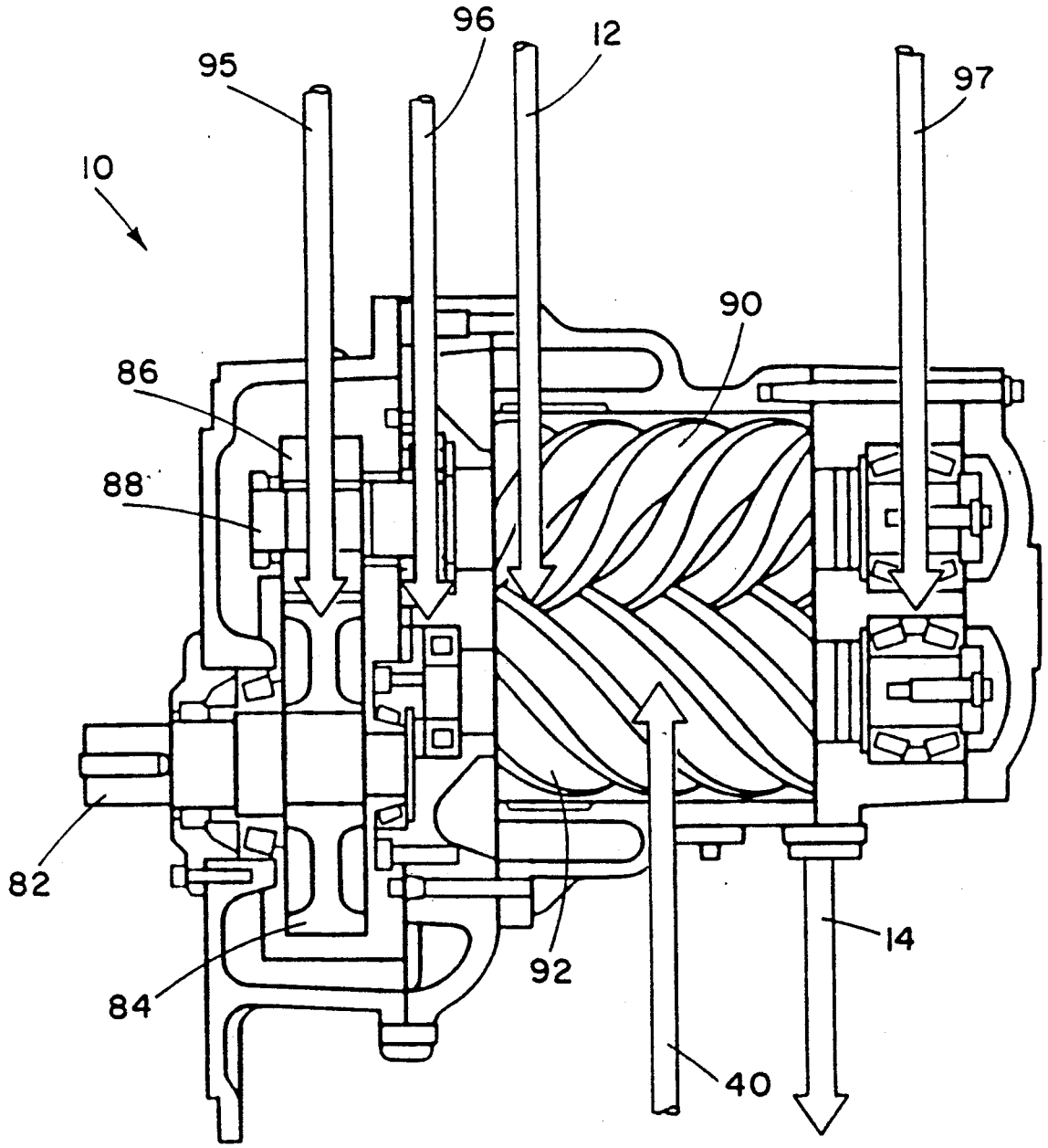
FIG. 2 is a section view of an exemplary rotary screw vacuum pump that can be associated with the system of the present invention.

FIG. 2 illustrates a section view of a typical rotary screw vacuum pump 10. The vacuum pump 10 is provided with an input shaft 82 that is connected in driving relation with a first gear 84. The first gear 84 is arranged in gear mesh relation with a second gear 86. It should be clearly understood that the gearing arrangement shown in FIG. 2 is not directly related to the basic concept of the present invention and is not limiting to its scope. The gearing arrangement which comprises gears 84 and 86 is merely used to increase the speed of operation of the vacuum pump shown in FIG. 2. The second gear 86 is associated with a shaft 88 that is connected to a male rotor 90 of the rotary screw vacuum pump 10. The male rotor 90 is provided with helical threads that are in mesh relation with threads of a female rotor 92. These two rotors provide the compression capability of the vacuum pump 10. Various locations within the vacuum pump 10 require lubrication to prevent damage that would otherwise be caused by wear and overheating. For example, the region in which the first and second gears, 84 and 88 respectively, are located requires the provision of lubricating fluid. That lubricating fluid would be provided on line 95 and would provide lubrication for the gears shown in FIG. 2. In addition, the bearings located at the inlet end of the male and female rotors require lubrication. That lubrication would be provided on line 96. As can also be seen in FIG. 2, the exhaust end of the male and female rotors is supported by bearings which also require lubrication. This lubrication is accomplished by providing a lubricating fluid through line 97 as indicated. It should be appreciated that lines 95, 96 and 97 are shown schematically in FIG. 2 and do not represent either a specific relative size or a particular location of connection between the lines and the vacuum pumps 10. Instead, they are shown schematically to illustrate the fact that the vacuum pump 10 requires lubrication and that lubrication can be provided by a plurality of appropriately located conduits. It should also be appreciated that lines, 95, 96 and 97 represent the connections shown between line 22 in FIG. 1 and the vacuum pump 10 in FIG. 1. In other words, the lubricating fluid provided by the oil reservoir 18 is transmitted through line 20 and line 22, by action of pump 24, into lines 95, 96 and 97 to provide lubricating fluid for the particular locations illustrated in FIG. 2 by the arrows 95, 96 and 97.

In FIG. 2, line 12 represents the inlet of the vacuum pump 10 through which process gasses pass from the area being evacuated toward the inlet of the vacuum pump 10. This inlet is connected in fluid communication with the inlet end of the male and female rotors, 90 and 92, and permits the rotation of the rotors to compress the gas as the gas is moved from left to right in FIG. 2. As a result of the size of the inlet port in a typical rotary screw vacuum pump, the compression of the inlet gas does not actually take place to a significant degree until the gas passes approximately one-third to one-halfway along the length of the male and female rotors. As the compression begins to increase the pressure of the gas as the gas moves from left to right in FIG. 2, heat is generated and the temperature of the gas increases. This increase in temperature begins to take place approximately one-third to one-half of the way along the rotors measured from the left, or inlet, end of the rotors. Therefore, the coolant is injected into the vacuum pump 10 at a point which is proximate the female rotor 92 approximately one-half of the way along the rotor from the inlet end of the rotor. The coolant is provided on line 40 and is injected into fluid communication with the female rotor 92 to provide cooling from the point of injection to the exhaust end of the rotors. After the gas is compressed, it is exhausted into line 14 which is connected in fluid communication with the exhaust port of the vacuum pump 10. By comparing FIGS. 1 and 2, the interaction between the system shown in FIG. 1 and the internal components of the vacuum pump 10 can be appreciated and understood. The oil which flows into vacuum pump 10 on lines 95, 96 and 97 is provided on these lines at a pressure which exceeds that of the Pressure of the coolant flowing through line 20 and the discharge pressure in line 14. This relative magnitude of pressure causes the lubricating fluid to pass from its points of injection toward the exhaust line 14. This relative difference in pressure also prevents contaminated coolant from migrating into the lubricated regions of the vacuum pump 10. As the lubricating fluid migrates from its injection points toward the male and female rotors and, eventually, into the exhaust line 14, it mixes with both the coolant fluid provided through line 40 and the gasses entering the vacuum pump 10 through line 12. This mixture of gasses, lubricating fluid and coolant places the gasses in intimate contact with both the lubricating liquid and the coolant liquid and creates a mixture of these three fluids which is exhausted through line 14. Since a lubricating fluid which is soluble in the coolant fluid has been used, the mixture permits the separation of trash gasses from the liquids within the fluid reservoir 16 and the recirculation of the resulting liquid mixture back to the coolant port of the vacuum pump 10 through line 40.

The present invention permits the use of a rotary screw vacuum pump in applications wherein trash gasses are to be evacuated by the pump. By providing separate cooling circuits and lubricating circuits, the present invention prevents damage from occurring in the gears, bearings and seals of the vacuum pump even though trash gasses are being evacuated by the pump and the process gasses contain elements which could otherwise be damaging if they came in contact with the bearings, gears and seals of the pump.

Although the present invention has been described in considerable detail and with a high degree of specificity, it should be understood that alternative embodiments of the present invention are to be considered within its scope. Even though the preferred embodiment of the present invention has been illustrated with considerable detail and described in terms of a particular arrangement, it should also be understood that alternative arrangements and alternative embodiments of the present invention are possible and are to be considered within its scope.

What I claim is:

1. A vacuum pump fluid control system, comprising:

first means for providing a flow of pressurized oil in fluid communication with a vacuum pump;

second means for providing a flow of pressurized water in fluid communication with said vacuum pump;

a fluid reservoir connected in fluid communication with a gas discharge of said pump, said reservoir being connected in fluid communication with said second providing means; and means for discharging gases from said fluid reservoir.

2. The system of claim 1, further comprising:

means for regulating the liquid level in said fluid reservoir.

3. The system of claim 2, wherein:

said regulating means comprises a means for directing water into said fluid reservoir and a means for draining liquid from said fluid reservoir.

4. The system of claim 3, wherein:

said regulating means comprises high level and low level sensors associated with said fluid reservoir.

5. The system of claim 4, further comprising:

a controller connected in signal communication with said high and low level sensors, said controller being connected in signal communication with a valve of said water directing means and a valve of said liquid draining means.

6. The system of claim 5, wherein:

said vacuum pump is a screw compressor.

7. A fluid control system, comprising:

a vacuum pump having an inlet port and an exhaust port;

a fluid reservoir connected in fluid communication with said exhaust part of said vacuum pump;

a first liquid provided at an oil supply connected in fluid communication with lubrication having an inlet to said vacuum pump and;

a second liquid provided as a cooling fluid inlet of said vacuum pump connected in fluid communication with said fluid reservoir.

8. The system of claim 7, further comprising:

a pump connected in fluid communication with said oil supply and with said lubrication inlets of said vacuum pump.

9. The system of claim 7, further comprising:

a pump connected in fluid communication with said cooling fluid inlet and said fluid reservoir.

10. The system of claim 7, further comprising:

means for draining said fluid reservoir.

11. The system of claim 10, further comprising:

means for filling said fluid reservoir from a fluid source external to said system.

12. The system of claim 11, further comprising:

means for sensing a quantity of liquid in said fluid reservoir.

13. The system of claim 12, further comprising:

means for controlling said quantity of liquid in said fluid reservoir between first and second predetermined magnitudes, said controlling means being connected in signal communication with said filling means and said draining means and in signal communication with said sensing means.

14. The system of claim 13, wherein:

said sensing means comprises a low liquid level sensor and a high liquid level sensor.

15. A method for controlling a vacuum pump fluid system, comprising:

providing a flow a first fluid as a lubricant from a lubricant source to at least one lubricant inlet of said vacuum pump;

providing a flow of a second fluid as a coolant from a fluid reservoir to a coolant inlet of said vacuum pump;

transmitting the exhaust of said vacuum pump into said fluid reservoir, and separating and removing gas from said liquid in said fluid reservoir, said coolant being provided from the liquid contained in said fluid reservoir.

16. The method of claim 15, further comprising:

regulating the liquid level of said fluid reservoir between a low limit and a high limit.

17. The method of claim 16, wherein:

said regulating step comprises providing additional liquid from an external supply when said liquid level falls below said low limit and draining said liquid from said fluid reservoir when said liquid level rises above said high limit.

18. The method of claim 17, wherein:

the pressure of said lubricant at said lubricant inlet is greater than the pressure of said vacuum pump exhaust; and said pressure of said lubricant at said lubricant inlet is greater than the pressure of said coolant at said coolant inlet of said vacuum pump.

19. The method of claim 16, further comprising:

periodically draining said coolant from said fluid reservoir until said liquid level decreases to said low limit; and refiling said fluid reservoir from an external supply until said liquid level increases to said high limit.

20. The method of claim ~~19, w~~herein:

said draining and refilling steps are scheduled by an automatic timer.

* * * * *